United States Patent [19]

Bekefi

[11] Patent Number: 4,465,953

[45] Date of Patent: Aug. 14, 1984

[54] RIPPLED-FIELD MAGNETRON APPARATUS

[75] Inventor: George Bekefi, Brookline, Mass.

[73] Assignee: The United States of America as represented by the Secretary of the Air Force, Washington, D.C.

[21] Appl. No.: 418,867

[22] Filed: Sep. 16, 1982

[51] Int. Cl.[3] ..... H01J 25/50

[52] U.S. Cl. ..... 315/39.71; 315/4; 315/5; 315/39.3; 315/5.35; 315/39.51

[58] Field of Search ..... 315/39.71, 39.3, 39.51, 315/3, 4, 5, 5.35

[56] References Cited

U.S. PATENT DOCUMENTS

| | | | |
|---|---|---|---|
| 2,890,372 | 6/1959 | Dench | 315/39.3 X |
| 2,940,006 | 6/1960 | Cuccia | 315/39.3 |
| 3,129,356 | 4/1964 | Phillips | 315/39.3 |
| 3,639,802 | 2/1972 | Belohoubek | 315/5.35 |
| 4,200,821 | 4/1980 | Bekefi et al. | 315/4 |
| 4,223,246 | 9/1980 | Osepchuk | 315/5.35 |
| 4,284,924 | 8/1981 | Dodonov | 315/39.71 |
| 4,298,824 | 11/1981 | Walsh | 315/4 |
| 4,392,078 | 7/1983 | Noble et al. | 315/5.35 |

*Primary Examiner*—Saxfield Chatmon

*Attorney, Agent, or Firm*—Donald J. Singer; William Stepanishen

[57] ABSTRACT

The rippled-field magnetron is a novel cross-field millimeter wave source in which electrons move under the combined action of a radial electric field, an axial magnetic field and an azimuthally periodic wiggler magnetic field, $|\vec{B}_w|$ cos (N$\theta$) oriented transversely to the flow. Estimates are given of the frequency and growth rate of the free electron laser (FEL) type of instability excited in this smooth-bore magnetron configuration.

10 Claims, 2 Drawing Figures

FIG. 1
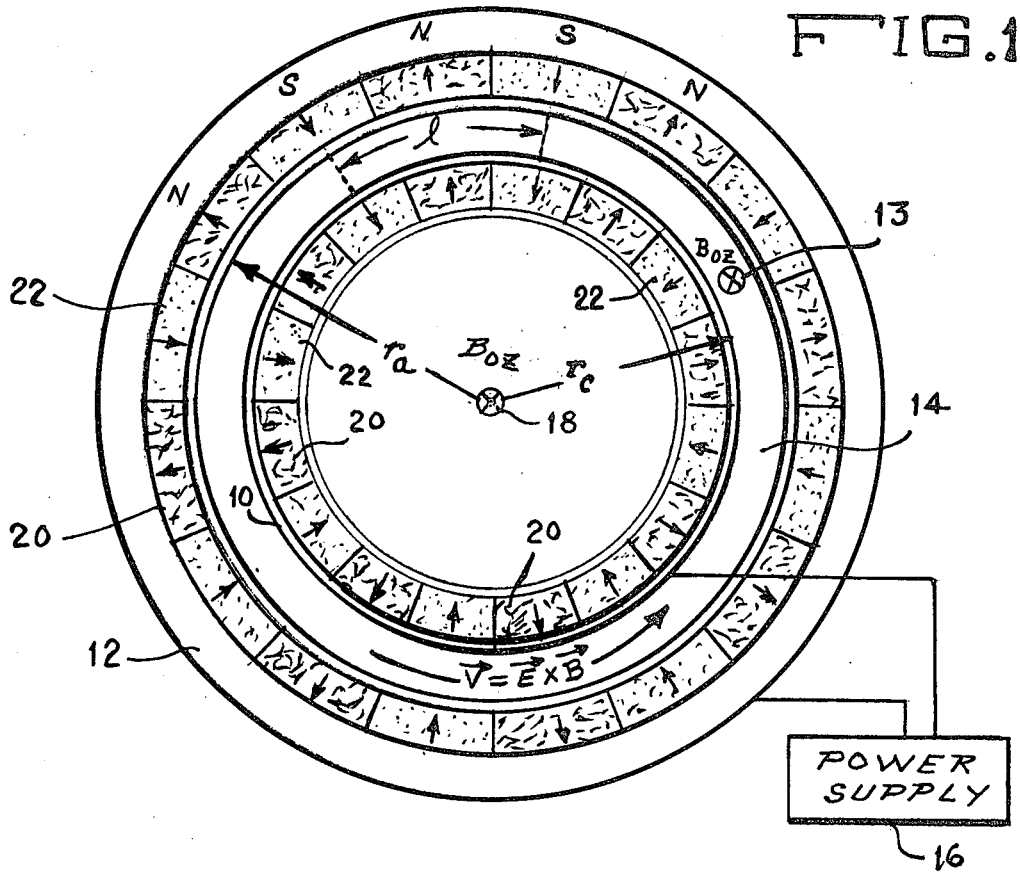
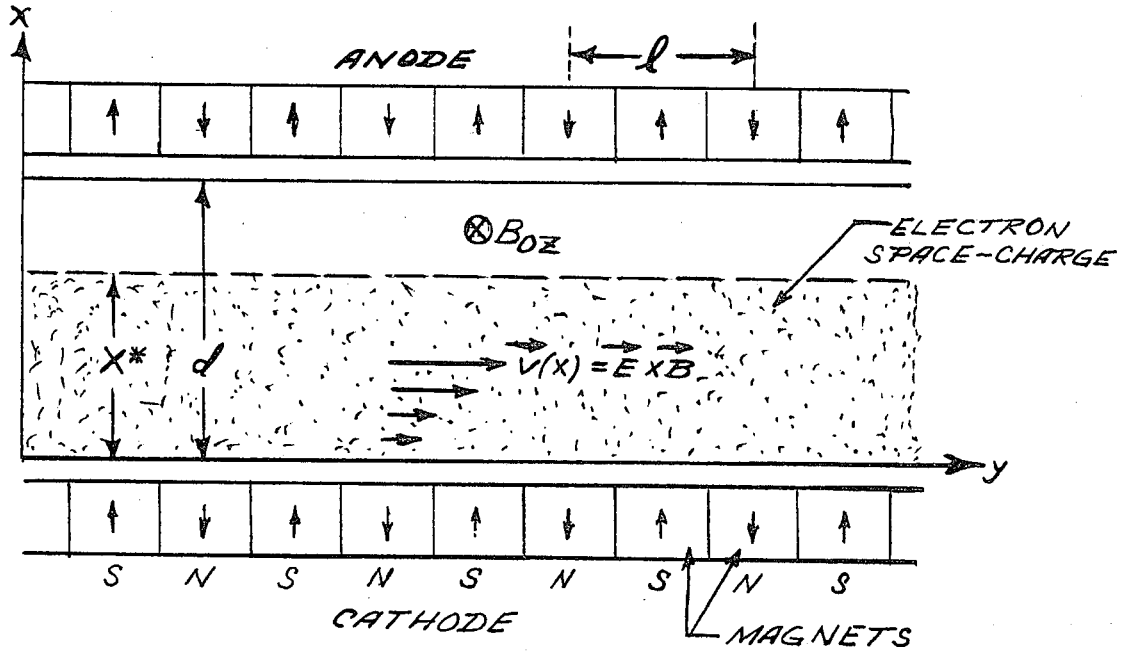
FIG. 2

RIPPLED-FIELD MAGNETRON APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a magnetron apparatus and in particular to a rippled-field magnetron apparatus.

In order to achieve efficient conversion of energy from a stream of free electroncs to electromagnetic radiation, near synchronism must be attained between the velocity of the electrons and the phase velocity of the wave. In crossed-field devices, of which the magnetron is a typical example, this synchronism occurs between electrons undergoing a $\vec{v}=\vec{E}_0\times\vec{B}_0$ drift in orthogonal electric and magnetic fields, and an electromagnetic wave whose velocity is reduced by a slow wave structure comprised of a periodic assembly of resonant cavities. This complex system of closely spaced resonators embedded in the anode block limits the conventional magnetron to wavelengths in the centimeter range. Moreover, at high power outputs typical of relativistic magnetrons, rf or dc breakdown in the electron-beam interaction space, and at the sharp resonator edges poses serious problems. The rippled-field magnetron is a novel source of coherent radiation devoid of physical slow-wave structures. Thus, the configuration of the anode and cathode is similar to the so-called "smooth-bore" magnetron. However, it differs from the smooth bore magnetron in that the electrons are subjected to an additional field, an azimuthally periodic (wiggler) magnetic field $\vec{B}_w$ oriented transversely to the flow velocity $\vec{v}$. The resulting $-e\vec{v}\times\vec{B}_w$ force gives the electrons an undulatory motion which effectively increases their velocity, and allows them to become synchronous with one of the fast TE or TM electromagnetic modes (phase velocity $\geqq c$) characteristic of the smooth-bore magnetron. We note that this technique is also the basis of free-electron lasers (FEL). Thus, in the rippled-field magnetron, the steady state electron motions are governed by well-known magnetron equilibria, but the high frequency wave instability which leads to the sought-for radiation is determined by a free electron laser like, parametric interaction. The device differs from the free electron laser in that the electron source (the cathode) and the acceleration region (the anode-cathode gap) are an integral part of the rf interaction space. This makes for high space-charge densities and for large growth rates of the free electron laser instability. Typically, the magnetron configuration is cylindrical rather than linear as in conventional free electron lasers, and the system is therefore very compact. The cylindrical geometry also allows for a continuous circulation of the growing electromagnetic wave and thus the system provides its own internal feedback. Therefore, the rippled-field magnetron is basically an oscillator rather than an amplifier as is the case of the free electron laser.

SUMMARY OF THE INVENTION

The present invention utilizes a magnetron in the form of a crossed-field millimeter wave source in which electrons move under the combined action of a radial electric field, an axial magnetic field, and an azimuthally periodic wiggler magnetic field oriented transversely to the electron flow. The electrons in the anode-cathode gap region which are subjected to the additional azimuthally periodic (wiggler) magnetic field, interact with one of the fast TE or TM electromagnetic modes in the same manner as in a free-electron laser.

It is one object of the present invention, therefore, to provide an improved rippled-field magnetron apparatus.

It is another object of the invention to provide an improved rippled-field magnetron apparatus to generate coherent electromagnetic radiation.

It is another object of the invention to provide an improved rippled-field magnetron apparatus operating in the millimeter and submillimeter wavelength ranges.

It is another object of the invention to provide an improved apparatus to utilize a compact magnetron geometry with a superimposed periodic wiggler magnetic field.

It is another object of the invention to provide an improved rippled-field magnetron apparatus to generate coherent electromagnetic radiation that is devoid of physical slow-wave structures.

These and other advantages, objects and features of the invention will become more apparent after considering the following description taken in conjunction with the illustrative embodiment in the accompanying drawings.

BRIEF DESCRIPTION OF THE DRAWINGS

FIG. 1 is a schematic diagram of the rippled-field magnetron apparatus, and, FIG. 2 is a plane view of the rippled-field magnetron apparatus according to the present invention.

DESCRIPTION OF THE PREFERRED EMBODIMENT

Referring now to FIG. 1, there is shown a rippled-field magnetron apparatus comprising a pair of coaxial cylindrical electrodes 10, 12. The inner cylindrical electrode 10 comprises the cathode of the rippled-field magnetron apparatus, while the electrode 12 comprises the anode. There is a region between the anode and the cathode which defines and establishes the interaction space or gap 14. The cathode electrode 10 has a radius, $r_c$ which is less than the radius, $r_a$ of the anode electrode 12. However, the cathode and anode can be interchanged such that the cathode is the outer electrode and the anode the inner electrode, and then $r_c$ is greater than $r_a$. The interaction gap, 14, is equal to radius, $r_c$ minus radius, $r_a$. A power supply unit 16 is connected between the cathode 10 and the anode 12 to establish an electric field in the interaction space, 14. A uniform magnetic field 13 which may be generated by any convenient and suitable conventional means, is established parallel to the geometric axis of the rippled-field magnetron apparatus.

A series of alternating permanent magnets segments 20, 22 are embedded along both cylindrical electrodes 10, 12. The alternating series of permanent magnet segments 20, 22 provide a radially disposed changing magnetic field in the interaction space 14 which establishes a wiggler field therein.

The rippled-field magnetron apparatus operates in the following manner. The electric field generating means comprises a smooth cylindrical anode of radius $r_a$ enclosing a smooth coaxial cylindrical cathode of radius $r_c$. The electrons, emitted by the cathode either thermionically or by field emission from a cold metal surface, are subjected simultaneously to two steady, or quasi-steady fields acting at right angles to one another: a uniform, axial magnetic field $B_{0z}$ produces by say a solenoid, and a radial electric field $E_{0r}(r)$ generated by applying a voltage V between the electrodes. As a result, a space charge cloud forms, partially filling the interaction gap $(r_a-r_c)$: the electrons undergo azimuthal rotation having a sheared, radially dependent velocity $v_\theta=E_{0r}(r)/B_{0z}$. To achieve this Brillouin flow equilibrium, the voltage V must be turned on slowly on a time scale long compared with the cyclotron period; and the strength of the magnetic field must exceed the critical field $$B_{0c}=(m_0c/ed_e)(\gamma_0^2-1)^{\frac{1}{2}} \quad (1)$$

where e and $m_0$ are the electron charge and rest mass, respectively, $$\gamma_0=1+(eV/m_0c^2) \text{ and } d_e\equiv(r_a^2-r_c^2)/2r_a$$

is the effective anode cathode gap width. Superimposed on the E and B fields is an azimuthally periodic magnetic (wiggler) field of the form $|\vec{B}_w|\cos(\vec{N}_\theta)$ where $B_w$ is the amplitude of the field and $N=2\pi r_c/l$ the number of spatial periods (l is the linear periodicity). In FIG. 1 the wiggler field is primarily in the radial direction and could be generated, for example, by samarium-cobalt bar magnets embedded in the anode and cathode blocks (but protected from the electron stream by the smooth, non-magnetic metal electrodes). The resulting periodic force acting on the electrons is along the $\pm z$ axis which is also the direction of polarization of the emitted radiation. Alternatively one can envision a wiggler magnetic field oriented primarily along the z axis in which case the electrons experience a periodic radial force, with the result that the ensuing radiation will also be radially polarized.

Turning now to FIG. 2, there is shown a rippled-field magnetron apparatus that is illustrated by a planar analog of the cylindrical apparatus of FIG. 1. When the anode-cathode gap $d=(r_a-r_c)$ is small compared with the anode radius $r_a$, it is possible to approximate the cylindrical device by a planar analog. In this case, a fully relativistic analysis of the Brillouin flow equilibrium and of the small amplitude wave perturbations of the flow has been worked out in the absence of the wiggler magnetic field $\vec{B}_w$. It may be observed that when $B_{0z}$ exceeds $B_{0c}$ as given by equation (1), an electron space charge partially fills the anode-cathode gap d to a thickness $x=x^*$ determined by the simultaneous solution of the equations $$\gamma_0\cos h(\alpha x^*)=1+A\sin h(\alpha x^*) \quad (2)$$

$$\alpha(d-x^*)=(1+A^2-\gamma_0^2)^{\frac{1}{2}} \quad (3)$$

where $A=eB_{0z}d/m_0c$ and $\gamma_0=1+eV/m_0c^2$. The constant $\alpha$, likewise obtained from solving equations (2) and (3), specifies the remaining parameters of the equilibrium flow, namely the electron velocity and density distributions $v_y(x)=c\tan h(\alpha x)$, $n(x)=(m_0c^2\epsilon_0/e^2)\alpha^2\cos h(\alpha x)$, and the self-consistent electric and magnetic fields in the sheath, $E_x(X)=\alpha(m_0c^2/e)\sin h(\alpha x)$ and $B_z(x)=\alpha(m_0c/e)\cos h(\alpha x)$. It may be noted that at every position $x\leqq x^*$ the nonrelativistic plasma frequency $\omega_p=(ne^2/m_0\epsilon_0)^{\frac{1}{2}}$ and the nonrelativistic cyclotron frequency $\Omega=(eB_z/m_0)$ are related through $\omega_p(x)=\Omega(x)/\gamma^{\frac{1}{2}}(x)$, where $\gamma(x)=\cos h(\alpha x)$. Thus $\omega_p$ and $\Omega$ are of the same order of magnitude, and at large operating magnetic fields $B_{0z}\gtrsim 10$ kg, $\Omega\gtrsim 10^{11}$ sec$^{-1}$. Hence the plasma frequency can be large which is important in achieving large levels of electromagnetic radiation.

Superposed on the Brillouin flow are slow (quasi-electrostatic) space-charge waves propagating along the y axis. Their dispersion characteristics have been studied extensively both for nonrelativistic and relativistic flows. Of particular interest is a class of short wavelength surface waves associated with a resonant interaction occurring with electrons that reside at or near the surface of the space-charge, $x\simeq x^*$. For these waves the real part of the dispersion equation is given by approximately $$\omega_r\simeq kv_y(x=x^*)=kc\tan h(\alpha x^*) \quad (4)$$

Here $\omega_r$ is the real part of the complex frequency $\omega$ and k the real wave number; and $\alpha$ and $x^*$ are determined from equations (2) and (3).

In the presence of the wiggler field which has been ignored up to this point, the dispersion equation (4) takes on the form $$\omega_r\simeq(k+k_0)c\tan h(\alpha x^*) \quad (5)$$

where $k=2\pi/l$ and l is the period (see FIG. 2). As a result, the phase velocity of the wave $\omega_r/k$ is increased by a factor $1+(k_0/k)$. This enables the slow space charge wave to interact in phase synchronism with the (fast) electromagnetic wave that propagates in the anode-cathode gap. Setting $\omega_r\simeq kc$ for the electromagnetic wave (thereby neglecting effects due to the proximity of the electrode walls), and substituting for k in equation (5), yields the radiation frequency, $$\omega_r\simeq k_0c\tan h(\alpha x^*)[1-\tan h(\alpha x^*)]^{-1}. \quad (6)$$

When the external axial magnetic field $B_{0z}$ equals the critical field $B_{0c}$ of equation (1), the electron space charge fills the entire gap and $x^*=d$. Now, $\tan h(\alpha d)=(\gamma_0^2-1)^{\frac{1}{2}}/\gamma_0$ and $\omega=\gamma_0^2k_0c\beta_0[1+\beta_0]$ where $\beta_0\equiv(1-(1/\gamma_0^2))^{\frac{1}{2}}$, which is the familiar result for the frequency of a free electron laser. As $B_{0z}$ is increased relative to $B_{0c}$, the space charge thickness $x^*$ shrinks, and $v_y(x=x^*)$ and the radiation frequency $\omega$ decrease. It is now possible to compare the frequency given by equation (6) with the radiation frequency $\omega\simeq k_0c\tan h(\alpha x^*)$ of a conventional magetron whose anode is pierced with a periodic assembly of resonators separated by a distance $\pi/k_0$. It may be seen that for the same operating parameters (the same values of $\alpha$ and $x^*$), the rippled-field magnetron radiates at a higher frequency than the conventional magnetron, and when $\tan h(\alpha x^*)$ approaches unity as is the case for relativistic velocities, the frequency enhancement over a conventional magentron is very large.

The temporal growth rate of the wave amplitude may be estimated from the expression:

$$\omega_i=f^{\frac{1}{4}}[\gamma(x^*)^{\frac{1}{2}}\omega_p(x^*)/4\omega_r]^{\frac{1}{2}}\Omega_w \quad (7)$$

applicable to free electron lasers operating in the high gain collective, Raman regime. Here $\omega_r$ is the radiation frequency given by equation (6), $\omega_i$ is the imaginary part of the complex frequency $\omega$, $\Omega_w=eB_w/m_0$ is the nonrelativistic electron cyclotron frequency in a wiggler magnetic field of amplitude $B_w$, and $$\omega_p(x^*)=[n(x=x^*)e^2/m_0\epsilon_0]^{\frac{1}{2}}$$

is the nonrelativistic plasma frequency of the resonant layer $x=x^*$. F is a phenomenological filling factor which describes the amplitude coupling of the electron stream to the electromagnetic wave. For a plane wave interacting with an infinitely wide electron stream of monoenergetic electrons, F is unity. For a sheared stream of electrons that is narrower than the electromagnetic beam, F is approximately given by the ratio of the beam area occupied by the resonant electrons at and near the sheath surface, to the electromagnetic beam area. Table 1 lists the computed characteristics of a rippled-field magnetron radiating at a wavelength of 1.3 mm and operating at a voltage of 1022 kV, an axial magnetic field $B_{0z}=10.32$ kG, and a wiggler field B=2.28 kG, a value readily achieved in the 0.5 cm wide gap by use of samerium-cobalt bar magnets. The wiggler periodicity 1=1 cm and the total number of periods N around the anode cylinder is 26. It may be seen from the operating parameters given in Table 1 that the device is very compact.

TABLE I

Summary of Operating Parameters of a Rippled Field Magnetron

| | |
|---|---|
| $r_a$ | = 4.64 cm |
| $r_c$ | = 4.14 cm |
| V | = 1.022 MV |
| $B_{0z}$ | = 10.32 kG |
| $B_{0c}$ | = 10.20 kG |
| $B_z(x^*)$ | = 13.54 kG |
| $E_x(x^*)$ | = $3.60\times10^6$ V/cm |
| $V_y(x^*)/c$ | = 0.885 |
| $x^*/d$ | = 0.758 |
| $\omega_p(x^*)$ | = $1.62\times10^{11}$ sec$^{-1}$ |
| $\Omega(x^*)$ | = $2.38\times10^{11}$ sec$^{-1}$ |
| $B_w$ | = 2.28 kG |
| N | = 26 |
| $\omega_r$ | = $1.46\times10^{12}$ sec$^{-1}$ |
| $\omega_i$ | = $8.11\times10^9$ sec$^{-1}$ |

The value $x^*$ has been chosen arbitrarily to be approximately three quarters of the full gap width d=0.5 cm. Thus, the computed radiation frequency $\omega_r$ is less than the maximum possible with given operating parameters. The maximum value of $\omega_r$ obtained when $x^*=d$ equals $3.12\times10^{12}$sec$^{-1}$. The temporal growth rate was computed for the case of an ideal filling factor, F=1. The value $\omega_i=8.11\times10^9$sec$^{-1}$ corresponds to a spatial power growth of 2.3 dB/cm. Hence the wave would increase by ~70 dB in going once around the interaction space.

In conclusion, there has herein been described the basic concepts of a novel source of coherent electromagnetic radiation which is capable of generating waves in the millimeter and submillimeter wavelength ranges. It employs the compact magnetron geometry with a super-imposed periodic wiggler magnetic field which replaces the periodic assembly of resonators in conventional magnetrons. The instability mechanism is that of the high gain free electron laser operating in the high density collective regime. Therefore, although the invention has been described with reference to a particular embodiment, it will be understood to those skilled in the art that the invention is capable of a variety of alternative embodiments within the spirit and scope of the appended claims.

What is claimed is:

1. A rippled-field magnetron apparatus comprising in combination:

a first means which is a cylindrical anode with a radius, $r_a$, a second electrode which is a cylindrical cathode with a radius, $r_c$, said cathode being coaxially enclosed withing said anode to form an anode-cathode gap, d, therebetween, said radius, $r_a$, being greater than radius, $r_c$, means for generating a uniform, axial magnetic field positioned within said cylindrical cathode, means for generating a radial electric field in said anode-cathode gap, d, and, a periodic magnetic field arranged azimuthally along both said anode and cathode to form a wiggler field, said wiggler field being generated in a radial direction with respect to said anode and cathode.

2. A rippled-field magnetron apparatus as described in claim 1 wherein said anode-cathode gap, d is defined by $$d=(r_a-r_c).$$

3. A rippled-field magnetron apparatus as described in claim 1 wherein both said anode and said cathode comprise smooth cylindrical electrodes.

4. A rippled-field magnetron apparatus as described in claim 1 wherein said magnetron field generating means comprises a solenoid.

5. A rippled-field magnetron apparatus as described in claim 1 wherein said electric field generating means comprises a voltage applied between said first and second electrodes.

6. A rippled-field magnetron apparatus as described in claim 1 wherein said periodic magnetic field comprises a plurality of magnet segments embedded respectively in said anode and cathode.

7. A rippled-field magnetron apparatus as described in claim 5 wherein said voltage is applied slowly on a long time scale as compared to the period of said magnetron.

8. A rippled-field magnetron apparatus as described in claim 6 wherein said period magnetic field has the form $|\vec{B}_w|\cos(N\theta)$ where $\vec{B}_w$ is the amplitude of the field and $N=2\pi r_c/l$, the number of spatial periods.

9. A rippled-field magnetron apparatus as described in claim 6 wherein both said anode and cathode comprise smooth non-magnetic electrodes.

10. A rippled-field magnetron apparatus as described in claim 6 wherein said magnet segments comprise samarium-cobalt bar magnets.

* * * * *